US011441498B1

(12) United States Patent
Dudar

(10) Patent No.: US 11,441,498 B1
(45) Date of Patent: Sep. 13, 2022

(54) METHOD AND SYSTEM FOR REDUCING EVAPORATIVE EMISSIONS

(71) Applicant: Ford Global Technologies, LLC, Dearborn, MI (US)

(72) Inventor: Aed Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/305,222

(22) Filed: Jul. 1, 2021

(51) Int. Cl.
*F02D 41/00* (2006.01)
*F02M 25/08* (2006.01)

(52) U.S. Cl.
CPC ..... *F02D 41/004* (2013.01); *F02D 41/0035* (2013.01); *F02M 25/0836* (2013.01); *F02M 25/0854* (2013.01); *F02D 2200/0602* (2013.01)

(58) Field of Classification Search
CPC ..... F02D 41/004; F02D 41/0035; F02D 2200/0602; F02M 25/0836; F02M 25/0854
See application file for complete search history.

(56) References Cited

U.S. PATENT DOCUMENTS

| | | | | |
|---|---|---|---|---|
| 6,658,925 | B2 | 12/2003 | Cook et al. | |
| 10,981,774 | B2 | 4/2021 | Dudar | |
| 2015/0306951 | A1* | 10/2015 | Shimokawa | F02M 25/0836 206/205 |
| 2016/0369722 | A1* | 12/2016 | Wakamatsu | F02M 25/0854 |
| 2017/0198622 | A1 | 7/2017 | Creedon et al. | |
| 2017/0292475 | A1* | 10/2017 | Dudar | F02D 41/0037 |
| 2019/0040821 | A1* | 2/2019 | Ishihara | F02M 25/0818 |
| 2019/0293031 | A1* | 9/2019 | Dudar | F01N 3/10 |
| 2020/0070649 | A1 | 3/2020 | Dudar | |
| 2020/0182174 | A1* | 6/2020 | Dudar | F02M 25/089 |
| 2020/0247252 | A1* | 8/2020 | Dudar | F02D 41/0032 |
| 2020/0370497 | A1* | 11/2020 | Dudar | B60K 15/03504 |
| 2021/0239057 | A1* | 8/2021 | Uchida | F02M 25/0809 |

* cited by examiner

*Primary Examiner* — George C Jin
(74) *Attorney, Agent, or Firm* — Vincent Mastrogiacomo; McCoy Russell LLP

(57) ABSTRACT

Methods and systems are presented for controlling flow through a recirculation tube of an evaporative emissions system. The methods and systems may adjust flow through the recirculation tube by controlling an amount of time an evaporative emissions system valve is held open and held closed during refilling of a fuel tank.

18 Claims, 4 Drawing Sheets

METHOD AND SYSTEM FOR REDUCING EVAPORATIVE EMISSIONS

FIELD

The present description relates generally to methods and systems for reducing evaporative emissions via a recirculation tube during fuel refilling.

BACKGROUND/SUMMARY

A vehicle may be refueled via a stationary pump that is powered via an electric power grid. Stationary pumps may supply fuel at a constant and relatively high flow rate. However, there may be fuel flow rate variability between fuel refilling stations. In addition, mobile fuel refilling services are becoming more popular. Mobile fuel refilling services may use 12 volt pumps that lack fuel flow rates that are equivalent to fuel flow rates of stationary fuel pumps. While lower flow rate fuel pumps may increase fuel refilling time, fuel refilling time is not the only difference that may result from fueling a vehicle with a lower flow rate fuel pump. In particular, pumping fuel into a fuel tank at a lower flow rate may affect carbon filled canister utilization and evaporative emissions system operation. For example, if fuel is pumped into a fuel tank at a slow rate, there may be insufficient pressure within the fuel tank to cause fuel vapors to recirculate in a recirculation tube. As a result, a greater amount of fuel vapor may flow to a carbon filled canister during fuel refilling, which may cause fuel vapors to break through the carbon filled canister and into the atmosphere. Additionally, the lower fuel flow rate may cause a fuel level vent valve closing to lag such that fuel may enter fuel vapor lines, which may not be desirable.

The inventor herein has recognized the above-mentioned issue and have developed a method for operating an evaporative emissions system, comprising: repeatedly cycling an evaporative emissions system valve open and closed via a controller while a fuel tank is being filled.

By repeatedly cycling an evaporative emissions system valve open and closed while a fuel tank is being filled, it may be possible to provide the technical result of controlling a flow rate through a recirculation tube of an evaporative emissions system. The flow rate may be adjusted so that fuel vapor may be recirculated in a fuel tank so that less fuel vapor may be directed through a carbon filled canister. The fuel vapor that flows through the recirculation tube may reduce air entrainment in fuel, thereby reducing fuel vaporization. The flow rate through the recirculation tube may be adjusted via adjusting a pressure in a fuel tank so that a desired pressure in the fuel tank may be provided even though fuel flow rates into the fuel tank may vary. The desired pressure may cause a desired flow rate through the recirculation tube to occur.

The present description may provide several advantages. In particular, the approach may provide a desired flow rate (e.g., a constant flow rate) through a recirculation tube even though a fuel tank may be filled at different rates. Additionally, the approach may be implemented via different valves in an evaporative emissions system so that the approach is flexible. Further, the approach may reduce evaporative emissions by reducing vapor flow from a fuel tank to a carbon filled canister while a fuel tank is being refilled.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 2:
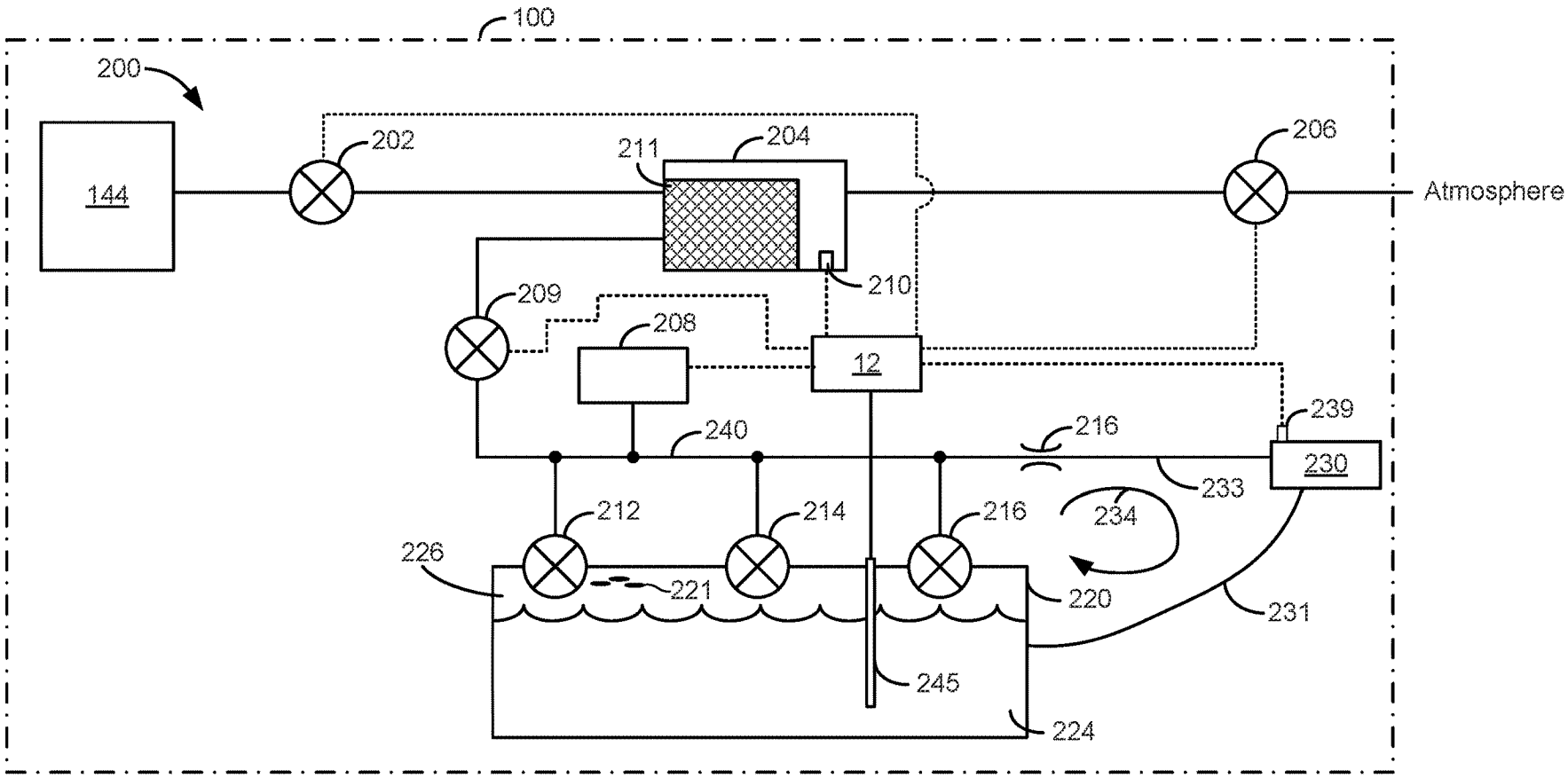
FIG. 2 shows a block diagram of an example evaporative emissions system for a vehicle.
Figure 3:
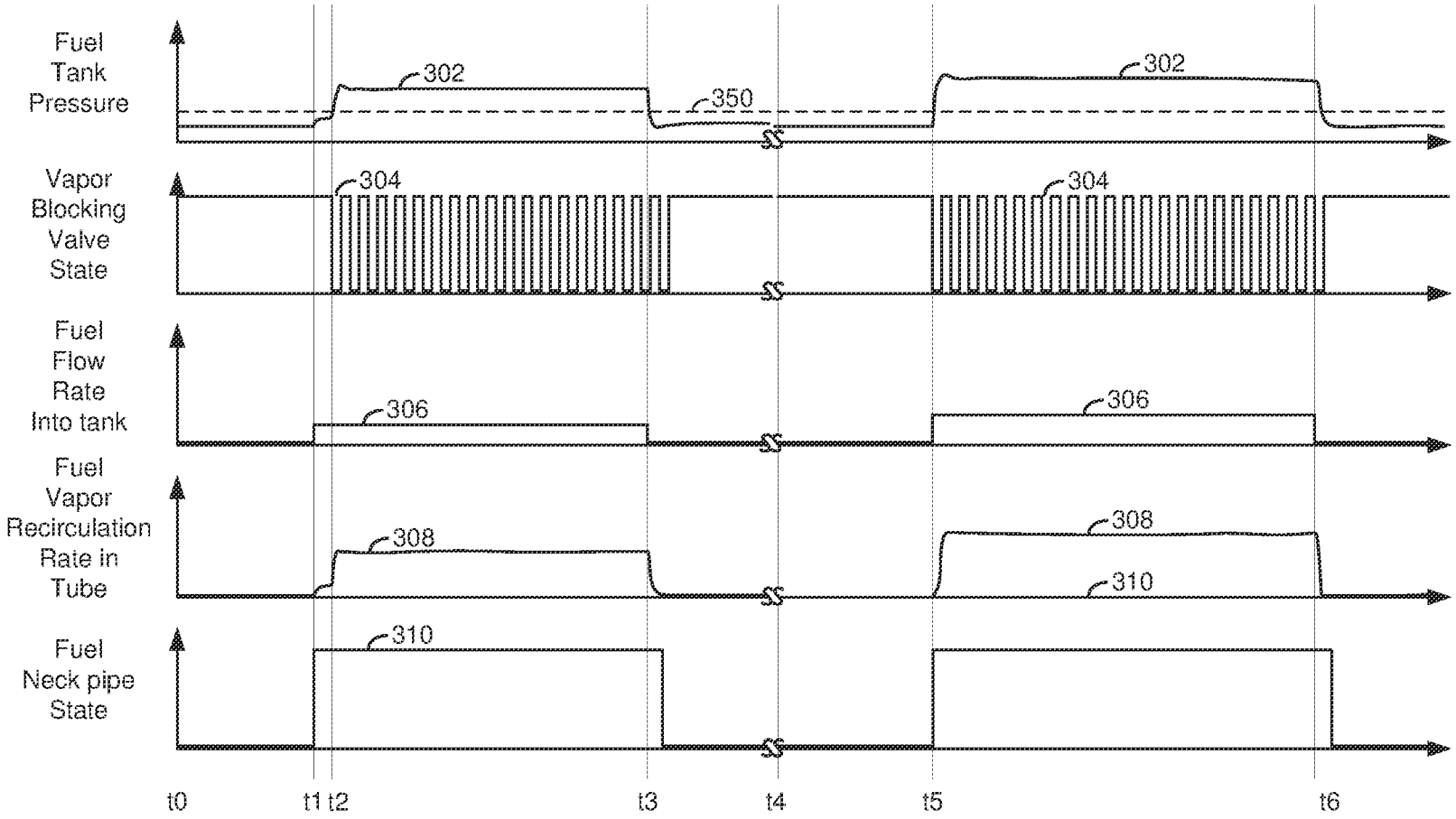
FIG. 3 shows an example evaporative emission system operating sequence according to the method of FIG. 4.

The following description relates to systems and methods for operating an evaporative emissions system that includes a recirculation tube. The recirculation tube may allow fuel vapors to be recirculated in a fuel tank so that less fuel vapors may be directed to a carbon filled canister. The recirculation tube may allow carbon filled canisters to be sized smaller as compared to if no recirculation tube were present. A vehicle may include an engine of the type shown in FIG. 1. The vehicle may also include an evaporative emissions system as shown in FIG. 2. The evaporative emissions system may be operated as shown in FIG. 3 to control a flow rate through a recirculation tube. The evaporative emissions system may be operated according to the method that is described by the flowchart in FIG. 4.

Figure 1:
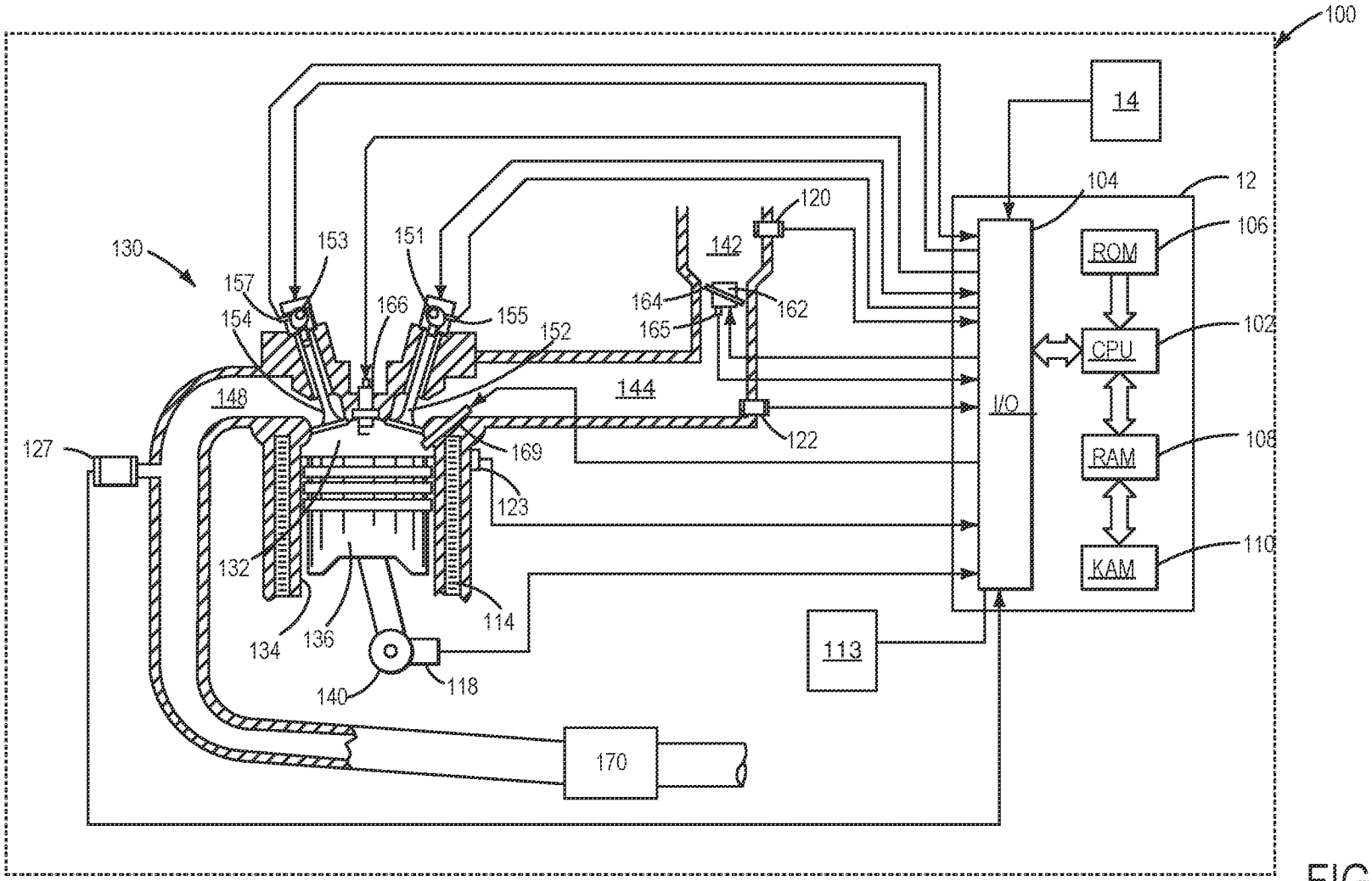
FIG. 1 shows an example engine that may be included in the systems and methods described herein.

Referring now to FIG. 1, vehicle 100 includes one or more controllers (e.g., controller 12 and autonomous driver 14) for receiving sensor data and adjusting actuators. Controller 14 may operate vehicle 100 autonomously such that vehicle 100 steers, brakes, increases vehicle speed, decreases vehicle speed, obeys traffic signals and signs, and responds to its surrounding conditions without being driven via a human operator. In some examples, controller 14 may cooperate with additional controllers (e.g., controller 12) to operate vehicle 100. Electrical connections between controller 14 and the various valves are indicated via dashed lines.

FIG. 1 shows a schematic diagram of one cylinder of a multi-cylinder engine 130. Engine 130 may be controlled at least partially by a control system including a controller 12 and by input from an autonomous driver or controller 14. Alternatively, a vehicle operator (not shown) may provide input via an input device, such as an engine torque, power, or air amount input pedal (not shown).

A combustion chamber 132 of the engine 130 may include a cylinder formed by cylinder walls 134 with a piston 136 positioned therein. The piston 136 may be coupled to a crankshaft 140 so that reciprocating motion of the piston is translated into rotational motion of the crankshaft. The crankshaft 140 may be coupled to at least one drive wheel of a vehicle via an intermediate transmission system. Further, a starter motor (not shown) may be coupled to the crankshaft 140 via a flywheel to enable a starting operation of the engine 130.

Combustion chamber 132 may receive intake air from an intake manifold 144 via an intake passage 142 and may exhaust combustion gases via an exhaust passage 148. The intake manifold 144 and the exhaust passage 148 can selectively communicate with the combustion chamber 132 via respective intake valve 152 and exhaust valve 154. In some examples, the combustion chamber 132 may include two or more intake valves and/or two or more exhaust valves.

In this example, the intake valve 152 and exhaust valve 154 may be controlled by cam actuation via respective cam actuation systems 151 and 153. The cam actuation systems 151 and 153 may each include one or more cams and may utilize one or more of cam profile switching (CPS), variable cam timing (VCT), variable valve timing (VVT), and/or variable valve lift (VVL) systems that may be operated by the controller 12 to vary valve operation. The position of the intake valve 152 and exhaust valve 154 may be determined by position sensors 155 and 157, respectively. In alternative examples, the intake valve 152 and/or exhaust valve 154 may be controlled by electric valve actuation. For example, the cylinder 132 may alternatively include an intake valve controlled via electric valve actuation and an exhaust valve controlled via cam actuation including CPS and/or VCT systems.

A fuel injector 169 is shown coupled directly to combustion chamber 132 for injecting fuel directly therein in proportion to the pulse width of a signal received from the controller 12. In this manner, the fuel injector 169 provides what is known as direct injection of fuel into the combustion chamber 132. The fuel injector may be mounted in the side of the combustion chamber or in the top of the combustion chamber, for example. Fuel may be delivered to the fuel injector 169 by a fuel system (not shown) including a fuel tank, a fuel pump, and a fuel rail. In some examples, the combustion chamber 132 may alternatively or additionally include a fuel injector arranged in the intake manifold 144 in a configuration that provides what is known as port injection of fuel into the intake port upstream of the combustion chamber 132.

Spark is provided to combustion chamber 132 via spark plug 166. The ignition system may further comprise an ignition coil (not shown) for increasing voltage supplied to spark plug 166. In other examples, such as a diesel, spark plug 166 may be omitted.

The intake passage 142 may include a throttle 162 having a throttle plate 164. In this particular example, the position of throttle plate 164 may be varied by the controller 12 via a signal provided to an electric motor or actuator included with the throttle 162, a configuration that is commonly referred to as electronic throttle control (ETC). In this manner, the throttle 162 may be operated to vary the intake air provided to the combustion chamber 132 among other engine cylinders. The position of the throttle plate 164 may be provided to the controller 12 by a throttle position signal. The intake passage 142 may include a mass air flow sensor 120 and a manifold air pressure sensor 122 for sensing an amount of air entering engine 130.

An exhaust gas sensor 127 is shown coupled to the exhaust passage 148 upstream of an emission control device 170 according to a direction of exhaust flow. The sensor 127 may be any suitable sensor for providing an indication of exhaust gas air-fuel ratio such as a linear oxygen sensor or UEGO (universal or wide-range exhaust gas oxygen), a two-state oxygen sensor or EGO, a HEGO (heated EGO), a $NO_x$, HC, or CO sensor. In one example, upstream exhaust gas sensor 127 is a UEGO configured to provide output, such as a voltage signal, that is proportional to the amount of oxygen present in the exhaust. Controller 12 converts oxygen sensor output into exhaust gas air-fuel ratio via an oxygen sensor transfer function.

The emission control device 170 is shown arranged along the exhaust passage 148 downstream of the exhaust gas sensor 127. The device 170 may be a three way catalyst (TWC), $NO_x$ trap, various other emission control devices, or combinations thereof. In some examples, during operation of the engine 130, the emission control device 170 may be periodically reset by operating at least one cylinder of the engine within a particular air-fuel ratio.

The controller 12 is shown in FIG. 1 as a microcomputer, including a microprocessor unit 102, input/output ports 104, an electronic storage medium for executable programs and calibration values shown as read only memory chip 106 (e.g., non-transitory memory) in this particular example, random access memory 108, keep alive memory 110, and a data bus. The controller 12 may receive various signals from sensors coupled to the engine 130, in addition to those signals previously discussed, including measurement of inducted mass air flow (MAF) from the mass air flow sensor 120; engine coolant temperature (ECT) from a temperature sensor 123 coupled to a cooling sleeve 114; an engine position signal from a Hall effect sensor 118 (or other type) sensing a position of crankshaft 140; throttle position from a throttle position sensor 165; and manifold absolute pressure (MAP) signal from the sensor 122. An engine speed signal may be generated by the controller 12 from crankshaft position sensor 118. Manifold pressure signal also provides an indication of vacuum, or pressure, in the intake manifold 144. Note that various combinations of the above sensors may be used, such as a MAF sensor without a MAP sensor, or vice versa. During engine operation, engine torque may be inferred from the output of MAP sensor 122 and engine speed. Further, this sensor, along with the detected engine speed, may be a basis for estimating charge (including air) inducted into the cylinder. In one example, the crankshaft position sensor 118, which is also used as an engine speed sensor, may produce a predetermined number of equally spaced pulses every revolution of the crankshaft.

The storage medium read-only memory 106 can be programmed with computer readable data representing non-transitory instructions executable by the processor 102 for performing at least portions of the methods described below as well as other variants that are anticipated but not specifically listed. Thus, controller 12 may operate actuators to change operation of engine 130. In addition, controller 12 may post data, messages, and status information to human/machine interface 113 (e.g., a touch screen display, heads-up display, light, etc.).

During operation, each cylinder within engine 130 typically undergoes a four stroke cycle: the cycle includes the intake stroke, compression stroke, expansion stroke, and exhaust stroke. During the intake stroke, generally, the exhaust valve 154 closes and intake valve 152 opens. Air is introduced into combustion chamber 132 via intake manifold 144, and piston 136 moves to the bottom of the cylinder so as to increase the volume within combustion chamber 132. The position at which piston 136 is near the bottom of the cylinder and at the end of its stroke (e.g. when combustion chamber 132 is at its largest volume) is typically referred to by those of skill in the art as bottom dead center (BDC).

During the compression stroke, intake valve 152 and exhaust valve 154 are closed. Piston 136 moves toward the cylinder head so as to compress the air within combustion chamber 132. The point at which piston 136 is at the end of its stroke and closest to the cylinder head (e.g. when combustion chamber 132 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 166, resulting in combustion.

During the expansion stroke, the expanding gases push piston 136 back to BDC. Crankshaft 140 converts piston movement into a rotational torque of the rotary shaft. Finally, during the exhaust stroke, the exhaust valve 154 opens to release the combusted air-fuel mixture to exhaust manifold 148 and the piston returns to TDC. Note that the above is shown merely as an example, and that intake and exhaust valve opening and/or closing timings may vary, such as to provide positive or negative valve overlap, late intake valve closing, or various other examples.

As described above, FIG. 1 shows only one cylinder of a multi-cylinder engine, and each cylinder may similarly include its own set of intake/exhaust valves, fuel injector, spark plug, etc.

Referring now to FIG. 2, a block diagram of an example evaporative emissions system 200 is shown. Evaporative emissions system 200 includes a canister purge valve 202, a carbon filled canister 204, a canister vent valve 206, a vapor blocking valve 209, a fuel tank pressure sensor 208, a carbon canister temperature sensor 210, a fuel tank cap 230, a first vent valve 212, a second vent valve 216, and a fuel limit vent valve 214. Carbon filled canister 204 may include activated carbon 211 to store fuel vapors 221. First vent valve 212 and second vent valve 216 may also be described as first grade vent valve 212 and second grade vent valve 216. The first vent valve 212, the fuel limit valve 214, and the second vent valve 216 may be fluidically coupled to the carbon containing canister 204 via a conduit 240. Vapor blocking valve 209 is positioned along conduit 240 and it may open and close to selectively permit fluidic communication between fuel tank 220 and carbon filled canister 204. Recirculation tube 233 is shown with an orifice 216 that may limit flow in recirculation tube 233. Fuel vapors may flow in recirculation tube 233 as indicated by arrow 234. Canister purge valve 202 may selectively provide fluidic communication between carbon canister 204 and intake manifold 144. Canister vent valve 206 may selectively provide fluidic communication between carbon canister 204 and atmosphere. Electrical connections between controller 14 and the various valves are indicated via dashed lines.

Fuel 224 in fuel tank 220 may generate vapors that migrate to vapor space 226 within fuel tank 220 when fuel 224 is exposed to warm temperatures and agitation. Fuel vapors may migrate from vapor space 226 toward atmosphere when either or both of vent valves 212 and 216 are closed. Fuel limit vent valve 214 may close during filling of fuel tank 220 to prevent overfilling of fuel tank 220. Fuel may flow from fuel cap 230 to fuel tank 220 via filler neck pipe 231. Fuel level sensor 245 may provide an indication of a fuel level in fuel tank 520. Additionally, sensor 239 may indicate when a fuel nozzle (not shown) is positioned to provide fuel to filler neck pipe 231 and fuel tank 220.

Thus, the system of FIGS. 1 and 2 provides for a vehicle system, comprising: a vehicle including an internal combustion engine, a fuel tank, and an evaporative emissions system valve; and one or more controllers in the vehicle, the one or more controllers including executable instructions stored in non-transitory memory that cause the one or more controllers to open and close the evaporative emissions system valve a plurality of times during refilling of the fuel tank. The vehicle system includes where the evaporative emissions system valve is a vapor blocking valve. The vehicle system includes where the evaporative emissions system valve is a canister vent valve. The vehicle system includes where the evaporative emissions system valve is opened and closed a plurality of times. The vehicle system further comprises additional instructions to adjust opening and closing the evaporative emissions system valve in response to a fuel tank pressure during refilling of the fuel tank. The vehicle system further comprises additional instructions to increase an amount of time that the evaporative emissions valve is closed in response to a pressure in the fuel tank being less than a first threshold. The vehicle system further comprises additional instructions to decrease an amount of time that the evaporative emissions valve is closed in response to a pressure in the fuel tank being greater than a second threshold.

Referring now to FIG. 3, an example sequence for operating an evaporative emissions system is shown. The sequence of FIG. 3 may be provided by the system of FIGS. 1 and 2 in cooperation with the method of FIG. 4. Vertical markers at times t0-t6 represent times of interest during the sequence. All of the plots occur at a same time and same vehicle operating conditions. The SS marks along the horizontal axes represent breaks in time and the duration of the break may be long or short.

The first plot from the top of FIG. 3 is a plot of fuel tank pressure (e.g., pressure in a fuel tank) versus time. The vertical axis represents the fuel tank pressure and the fuel tank pressure increases in the direction of the vertical axis arrow. The horizontal axis represents time and time increases from the left side of the plot to the right side of the plot. Trace 302 represents the fuel tank pressure. Horizontal line 350 represents a threshold pressure at or above which floe in the fuel tank recirculation tube is a desired level during refueling of the fuel tank.

The second plot from the top of FIG. 3 is a plot of an operating state of a vapor blocking valve in an evaporative emissions system versus time. The vertical axis represents the vapor blocking valve operating state and the vapor blocking valve is open when trace 304 is at a higher level near the vertical axis arrow. The vapor blocking valve is closed when trace 304 is at a lower level near the horizontal axis. The horizontal axis represents time and time increases from the left side of the plot to the right side of the plot. Trace 304 represents the vapor blocking valve operating state.

The third plot from the top of FIG. 3 is a plot of a fuel flow rate into the fuel tank from a filling nozzle versus time. The vertical axis represents the a fuel flow rate into the fuel tank and the a fuel flow rate into the fuel tank increases in the direction of the vertical axis arrow. The horizontal axis represents time and time increases from the left side of the plot to the right side of the plot. Trace 306 represents the fuel flow rate into the fuel tank.

The fourth plot from the top of FIG. 3 is a plot of a recirculation rate of fuel vapors in the recirculation tube versus time. The vertical axis represents the recirculation rate of fuel vapors in the recirculation tube and the recirculation rate of fuel vapors in the recirculation tube increases in the direction of the vertical axis arrow. The horizontal axis represents time and time increases from the left side of the plot to the right side of the plot. Trace 308 represents the recirculation rate of fuel vapors in the recirculation tube.

The fifth plot from the top of FIG. 3 is a plot of a state of a fuel neck pipe versus time. The vertical axis represents the fuel neck pipe state and a fuel nozzle (not shown) is in the fuel filler tube when trace 310 is at a level that is near the vertical axis arrow. The fuel filler nozzle is not in the fuel neck pipe when the fuel neck pipe state is near the horizontal axis. The horizontal axis represents time and time increases from the left side of the plot to the right side of the plot. Trace 310 represents the fuel neck pipe state.

At time t0, the pressure in the fuel tank is low, the vapor blocking valve is open, and the canister vent valve is open (not shown) so that fuel vapors may flow from the fuel tank to the carbon filled canister (not shown). The fuel flow rate into the fuel tank is zero and the fuel tank vapor recirculation rate is zero. The fuel filling nozzle is not in the fuel neck pipe.

At time t1, the fuel filling nozzle (not shown) is in the fuel neck pipe and it begins to deliver fuel to the fuel tank. Pressure in the fuel tank begins to increase. The vapor blocking valve is not cycled between open and closed. Rather, the vapor blocking valve remains open while refilling the fuel tank begins. The blocking valve remains open because the fuel tank pressure is low, which may be indicative of low flow in the fuel recirculation tube.

At time t2, the vapor blocking valve is closed in response to the fuel tank pressure not exceeding threshold 350. Thus, the evaporative emissions system may react to pressure in the fuel tank not indicating a desired level of vapor flow in the recirculation tube. Closing the vapor blocking valve may increase pressure in the fuel tank by reducing flow through the carbon filled canister. The fuel flow rate into the fuel tank continues at its previous level and the flow rate in the recirculation tube begins to increase along with the fuel tank pressure. The fuel neck pipe state continues to indicate that the fuel nozzle is in the fuel neck pipe.

Between time t2 and time t3, the vapor blocking valve is cycled from opened to closed. The vapor blocking valve may be cycled at a fixed frequency and the amount of time that the vapor blocking valve is closed may be based on the pressure in the fuel tank. In other examples, the vapor blocking valve may be cycled at different frequencies. The fuel tank continues to be filled and the flow rate in the recirculation tube increases and then levels off at a desirable level. The fuel flow rate into the fuel tank remains constant. The fuel neck pipe state continues to indicate that the fuel nozzle is in the fuel neck pipe.

At time t3, flow of fuel into the fuel tank ceases and the pressure in the fuel tank begins to drop. Flow of fuel into the fuel tank may stop due to a fuel nozzle operator releasing a fill handle or automatically in response to an increase in pressure within the fuel filler tube. The vapor blocking valve continues to be cycled between on and off. Recirculation of fuel vapor in the recirculation tube also drops in response to the reduction in the fuel flow rate into the fuel tank. The fuel neck pipe state continues to indicate that the fuel nozzle is in the fuel neck pipe.

Shortly after time t3, the fuel neck pipe state indicates that the fuel nozzle has been removed from the fuel neck pipe. Therefore, cycling of the vapor blocking valve is ceased. Pressure in the fuel tank remains low and the fuel flow rate into the fuel tank is zero. The recirculation rate of fuel vapors in the recirculation tube is also reduced to zero. A break in time occurs between time t3 and time t4.

At time t4, the pressure in the fuel tank is low, the vapor blocking valve is open, and the canister vent valve is open (not shown) so that fuel vapors may flow from the fuel tank to the carbon filled canister (not shown). The fuel flow rate into the fuel tank is zero and the fuel tank vapor recirculation rate is zero. The fuel filling nozzle is not in the fuel neck pipe.

At time t5, the fuel filling nozzle (not shown) is in the fuel neck pipe and it begins to deliver fuel to the fuel tank. Pressure in the fuel tank begins to increase. The vapor blocking valve is cycled between open and closed in response to the fuel filling nozzle being inserted into the fuel neck pipe. The flow rate in the recirculation tube begins to increase and the fuel neck pipe indicates that the fuel filling nozzle is in the fuel neck pipe. Thus, in this example, the vapor blocking valve is not cycled in response to pressure in the fuel tank.

Between time t5 and time t6, the vapor blocking valve is cycled from opened to closed. The vapor blocking valve may be cycled at a fixed frequency and the amount of time that the vapor blocking valve is closed may be based on the pressure in the fuel tank. In other examples, the vapor blocking valve may be cycled at different frequencies. The fuel tank continues to be filled and the flow rate in the recirculation tube increases and then levels off at a desirable level. The fuel flow rate into the fuel tank remains constant. The fuel neck pipe state continues to indicate that the fuel nozzle is in the fuel neck pipe.

At time t6, flow of fuel into the fuel tank ceases and the pressure in the fuel tank begins to drop. Flow of fuel into the fuel tank may stop due to a fuel nozzle operator releasing a fill handle or automatically in response to an increase in pressure within the fuel filler tube. The vapor blocking valve continues to be cycled between on and off. Recirculation of fuel vapor in the recirculation tube also drops in response to the reduction in the fuel flow rate into the fuel tank. The fuel neck pipe state continues to indicate that the fuel nozzle is in the fuel neck pipe.

Shortly after time t6, the fuel neck pipe state indicates that the fuel nozzle has been removed from the fuel neck pipe. Therefore, cycling of the vapor blocking valve is ceased. Pressure in the fuel tank remains low and the fuel flow rate into the fuel tank is zero. The recirculation rate of fuel vapors in the recirculation tube is also reduced to zero.

In these ways, a vapor blocking valve or a canister vent valve may be cycled between open and closed states to improve a flow rate in a recirculation tube. The VBV or CVV may be cycled as a function of pressure in the fuel tank or based on whether or not an indication of fueling the vehicle is present.

Figure 4:
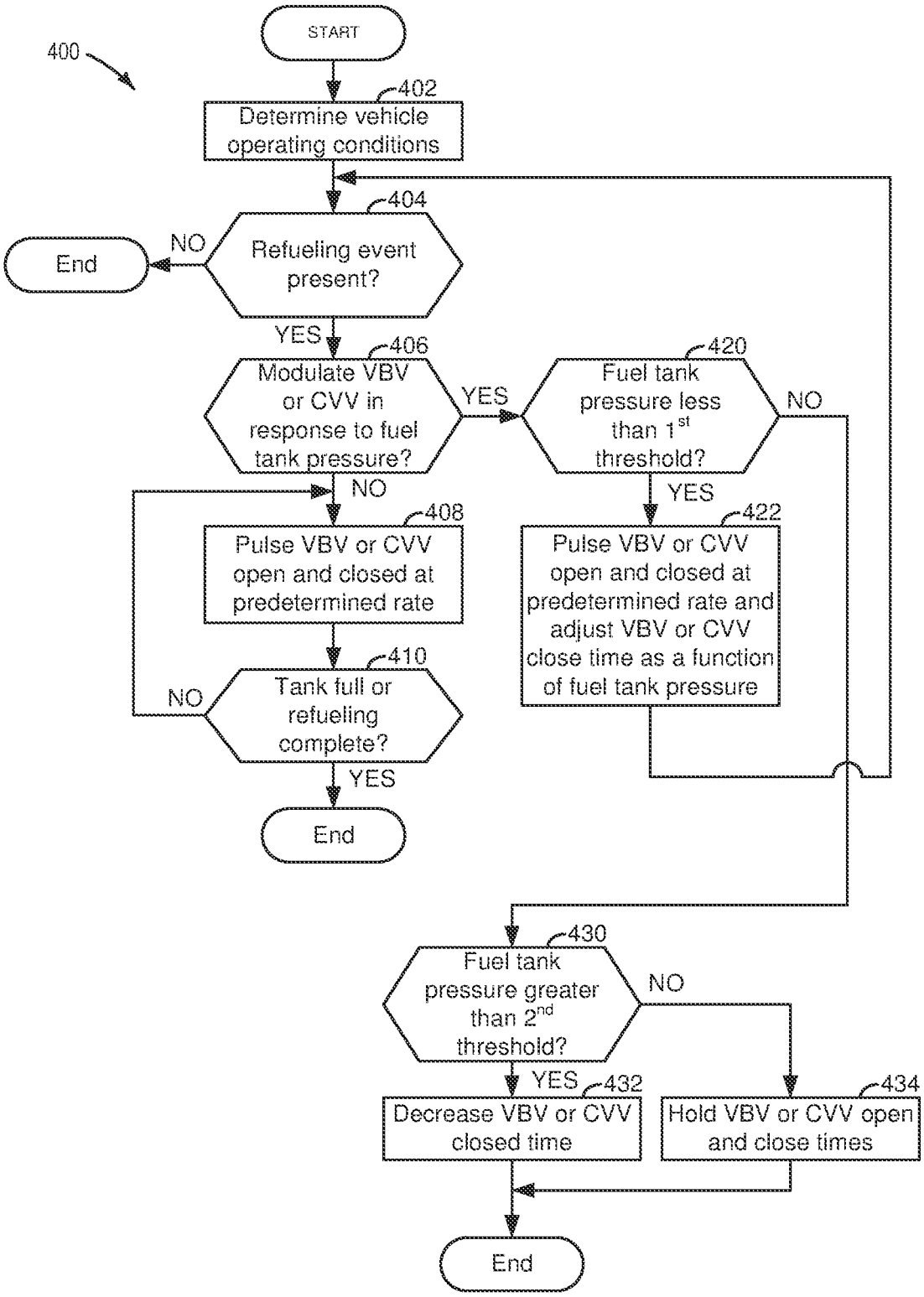
FIG. 4 shows an example method for operating an evaporative emissions system.

Referring now to FIG. 4, an example method 400 for operating an evaporative emissions system is shown. At least portions of method 400 may be included in and cooperate with a system as shown in FIGS. 1 and 2 as executable instructions stored in non-transitory memory. The method of FIG. 4 may cause the controller to operate actuators in the real world and receive data and signals from sensors described herein when the method is realized as executable instructions stored in controller memory.

At 402, method 400 determines vehicle operating conditions. Vehicle operating conditions may include but are not limited to fuel tank pressure, fuel filler neck state, engine temperature, ambient temperature, vehicle speed, a fuel level in a fuel tank, an amount of fuel vapor stored in a carbon filled canister, and engine state (e.g., on/off). Method 400 proceeds to 404.

At 404, method 400 judges if a vehicle is in the process of being refilled with fuel (e.g., a refueling event), or if the vehicle is about to be refilled with fuel. In one example, method 400 may judge that the vehicle is in the process of being refilled with fuel based on a position of a fuel filler cap. However, in other examples, method 400 may judge that the vehicle is in the process of being filled with fuel based on a pressure in the fuel tank. If method 400 judges that the vehicle is in the process of being filled with fuel, the answer is yes and method 400 proceeds to 406. Otherwise, the answer is no and method 400 proceeds to exit. In some examples, method 400 may close the vapor blocking valve (VBV) and the canister vent valve (CVV) if the answer is no.

At 406, method 400 judges if the VBV or the CVV is to be modulated (e.g., cycled between on and off) in response to a pressure in the vehicle's fuel tank. Method 400 may judge to cycle the VBV or the CVV in response to a pressure in the vehicle's fuel tank if the vehicle includes a pressure sensor in the fuel tank. If method 400 judges to modulate the VBV or CVV, the answer is yes and method 400 proceeds to 420. Otherwise, the answer is no and method 400 proceeds to 408.

At 408, method 400 pulses or repeatedly opens and closes the VBV or the CVV. The CVV may be repeatedly opened and closed if the evaporative emissions system does not include a VBV. The VBV or CVV may be opened and closed at a fixed frequency or at a frequency that varies. By opening and closing the VBV or CVV, a flow rate in the recirculation tube may be adjusted and controlled. The flow rate in the recirculation tube may increase when the VBV or CVV is closed because flow to the carbon filled canister and atmosphere may be reduced, thereby increasing pressure in the fuel tank and flow in the recirculation tube. Method 400 proceeds to 410.

At 410, method 400 judges if the fuel tank is full or if the refueling process is complete. In one example, method 400 may judge if the fuel tank is full based on output of a fuel level sensor. Method 400 may judge that fuel tank refilling is complete based on a position of a fuel filler cap. If method 400 judges that the fuel tank is full, or judges that the refueling process is complete, the answer is yes and method 400 proceeds to exit. If method 400 exits, the VBV and the CVV may be closed. If method 400 judges that the fuel tank is not full, or judges that the refueling process is not complete, the answer is no and method 400 returns to 408.

At 420, method 400 judges if a pressure in the fuel tank is less than a first threshold pressure. The first threshold pressure may be a fuel tank pressure at which a flow rate in the recirculation tube is a desired rate. If method 400 judges that the pressure in the fuel tank is less than the first threshold pressure, the answer is yes and method 400 proceeds to 422. Otherwise, the answer is no and method 400 proceeds to 430. A pressure in the fuel tank that is less than the first threshold may be indicative of a flow rate that is lower than a desired flow rate in the recirculation tube.

At 422, method 400 pulses the VBV or CVV open and closed at a predetermined rate. In addition, method 400 adjusts the closing time duration of the VBV or CVV as a function of pressure in the fuel tank. For example, if pressure in the fuel tank is a first pressure, the VBV closing time duration is set to a first time duration. If pressure in the fuel tank is a second pressure, the VBV closing time duration is set to a second time duration, the first pressure less than the second pressure, the first time duration longer than the second time duration. Alternatively, method 400 may adjust a frequency that the VBV is opened and closed as a function of the fuel tank pressure. Method 400 returns to 404.

At 430, method 400 judges if a pressure in the fuel tank is greater than a second threshold. If so, the answer is yes and method 400 proceeds to 432. Otherwise, the answer is no and method 400 proceeds to 434.

At 432, method 400 decreases the amount of time that the VBV or CVV is held closed. By decreasing the amount of time that the VBV or CVV is held closed, the pressure in the fuel tank may be decreased and along with the pressure decrease, flow in the recirculation tube may be decreased. Method 400 proceeds to exit.

At 434, method 400 holds the present closing timing duration of the VBV or the CVV. Since the fuel tank pressure is not greater than the second threshold, the fuel tank pressure may be maintained at its present value to provide a desired flow rate in the recirculation tube. Method 400 proceeds to exit.

In this way, a desired flow rate in a recirculation tube may be provided so that loading of a carbon filled canister may be reduced. The flow rate in the recirculation tube may be closed loop controlled via adjusting opening timing and closing timing of a VBV or a CVV according to pressure in the fuel tank, which may be a surrogate variable for flow in the recirculation tube.

Thus, method 400 provides for a method for operating an evaporative emissions system, comprising: repeatedly cycling an evaporative emissions system valve open and closed via a controller while a fuel tank is being filled. The method includes where the evaporative emissions system valve is a canister vent valve, and further comprising adjusting timing at which the evaporative emissions system valve is repeatedly cycled open and closed. The method includes where the evaporative emissions system valve is a vapor blocking valve, and further comprising adjusting timing at which the evaporative emissions system valve is repeatedly cycled open and closed. The method includes where adjusting timing at which the evaporative emissions system valve is repeatedly cycled open and closed includes increasing an amount of time that the evaporative emissions system valve is closed in response to a pressure of the fuel tank being less than a first threshold pressure. The method includes where adjusting timing at which the evaporative emissions system valve is repeatedly cycled open and closed includes decreasing an amount of time that the evaporative emissions system valve is closed in response to a pressure of the fuel tank being greater than a second threshold pressure. The method includes where adjusting timing at which the evaporative emissions system valve is repeatedly cycled open and closed includes adjusting the timing in response to a pressure in a fuel tank. The method further comprises holding open a canister vent valve while the fuel tank is being filled. The method further comprises holding closed a canister purge valve while the fuel tank is being filled.

Method 400 also provides for a method for operating an evaporative emissions system, comprising: adjusting a flow through a recirculation tube of an evaporative emissions system via controller according to a pressure in a fuel tank while the fuel tank is being filled. The method includes where adjusting the flow through the recirculation tube includes increasing flow through the recirculation tube. The method includes where adjusting the flow through the recirculation tube includes decreasing flow through the recirculation tube. The method includes where the flow is adjusted via adjusting an amount of time that a vapor blocking valve is held closed while the fuel tank is being filled. The method further comprises holding open a canister vent valve while the fuel tank is being filled.

Note that the example control and estimation routines included herein can be used with various engine and/or vehicle system configurations. Further, the methods described herein may be a combination of actions taken by a controller in the physical world and instructions within the controller. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A vehicle system, comprising:

a vehicle including an internal combustion engine, a fuel tank, and an evaporative emissions system valve; and one or more controllers in the vehicle, the one or more controllers including executable instructions stored in non-transitory memory that cause the one or more controllers to open and close the evaporative emissions system valve during refilling of the fuel tank, adjust opening and closing the evaporative emissions system valve in response to a fuel tank pressure during refilling of the fuel tank, and increase an amount of time that the evaporative emissions valve is closed in response to a pressure in the fuel tank being less than a first threshold.

2. The vehicle system of claim 1, where the evaporative emissions system valve is a vapor blocking valve.

3. The vehicle system of claim 1, where the evaporative emissions system valve is a canister vent valve.

4. The vehicle system of claim 1, where the evaporative emissions system valve is opened and closed a plurality of times.

5. The vehicle system of claim 1, further comprising additional instructions to decrease an amount of time that the evaporative emissions valve is closed in response to a pressure in the fuel tank being greater than a second threshold.

6. A method for operating an evaporative emissions system, comprising:

repeatedly cycling an evaporative emissions system valve open and closed via a controller while a fuel tank is being filled.

7. The method of claim 6, where the evaporative emissions system valve is a canister vent valve, and further comprising adjusting timing at which the evaporative emissions system valve is repeatedly cycled open and closed.

8. The method of claim 6, where the evaporative emissions system valve is a vapor blocking valve, and further comprising adjusting timing at which the evaporative emissions system valve is repeatedly cycled open and closed.

9. The method of claim 8, where adjusting timing at which the evaporative emissions system valve is repeatedly cycled open and closed includes increasing an amount of time that the evaporative emissions system valve is closed in response to a pressure of the fuel tank being less than a first threshold pressure.

10. The method of claim 8, where adjusting timing at which the evaporative emissions system valve is repeatedly cycled open and closed includes decreasing an amount of time that the evaporative emissions system valve is closed in response to a pressure of the fuel tank being greater than a second threshold pressure.

11. The method of claim 8, where adjusting timing at which the evaporative emissions system valve is repeatedly cycled open and closed includes adjusting the timing in response to a pressure in a fuel tank.

12. The method of claim 6, further comprising holding open a canister vent valve while the fuel tank is being filled.

13. The method of claim 11, further comprising holding closed a canister purge valve while the fuel tank is being filled.

14. A method for operating an evaporative emissions system, comprising:

adjusting a flow through a recirculation tube of an evaporative emissions system via controller according to a pressure in a fuel tank while the fuel tank is being filled.

15. The method of claim 14, where adjusting the flow through the recirculation tube includes increasing flow through the recirculation tube.

16. The method of claim 14, where adjusting the flow through the recirculation tube includes decreasing flow through the recirculation tube.

17. The method of claim 14, where the flow is adjusted via adjusting an amount of time that a vapor blocking valve is held closed while the fuel tank is being filled.

18. The method of claim 14, further comprising holding open a canister vent valve while the fuel tank is being filled.

* * * * *